US005722112A

United States Patent [19]

Scanni et al.

[11] Patent Number: 5,722,112

[45] Date of Patent: Mar. 3, 1998

[54] VACUUM ASSISTED BROOM

[76] Inventors: Iberio E. Scanni; Nino V. Scanni, both of 5199 Warwickshire Way, Mississauga, Ontario, Canada, L5V 1N5

[21] Appl. No.: 196,555

[22] Filed: Feb. 15, 1994

Related U.S. Application Data

[63] Continuation-in-part of Ser. No. 942,784, Sep. 10, 1992, abandoned.

[51] Int. Cl.[6] ..... A47L 5/24

[52] U.S. Cl. ..... 15/344; 15/350; 15/369; 15/373; 15/398

[58] Field of Search ..... 15/344, 350, 398, 15/369, 373, 184

[56] References Cited

U.S. PATENT DOCUMENTS

| | | | |
|---|---|---|---|
| 921,669 | 5/1909 | Boegel et al. | 15/369 |
| 928,982 | 7/1909 | Kindel | 15/369 |
| 1,971,493 | 8/1934 | Leathers | 15/369 |
| 2,178,427 | 10/1939 | Lang | 15/373 |
| 2,180,930 | 11/1939 | Mortensen | 15/369 |
| 2,236,989 | 4/1941 | Bjorkman | 15/369 |
| 2,324,111 | 7/1943 | Ross | 15/373 X |
| 2,591,262 | 4/1952 | Humphrey | 15/373 |
| 2,674,001 | 4/1954 | Abrams et al. | 15/184 |
| 3,079,626 | 3/1963 | Yonkers et al. | 15/350 X |
| 3,821,831 | 7/1974 | Grover | 15/373 X |
| 4,956,892 | 9/1990 | Fawkes | 15/398 X |
| 5,432,976 | 7/1995 | Alazet | 15/398 X |
| 5,440,782 | 8/1995 | Yamashita | 15/398 |

FOREIGN PATENT DOCUMENTS

| | | | |
|---|---|---|---|
| 1102148 | 5/1955 | France | 15/369 |
| 171745 | 6/1906 | Germany | 15/369 |
| 165448 | 2/1934 | Switzerland | 15/369 |

*Primary Examiner*—Chris K. Moore
*Attorney, Agent, or Firm*—Donald E. Hewson

[57] ABSTRACT

A vacuum assisted broom for sweeping floors having a sweeping member, preferably in the form of a plurality of stiff bristles, for bi-directional sweeping of the floor. The sweeping member is operatively mounted within a housing member, which housing member partially encloses the sweeping member within its hollow interior such that the bristles depend from the housing member through a first opening. A handle member is securely attached to the housing member and extends upwardly therefrom. The sweeping member is moveable between a first extended position the bristles are extended sufficiently that the broom may be used as a conventional broom, and a second retracted position where the sweeping member is substantially retracted into the housing member, with only a short end portion of the bristles extending outwardly from the housing member. The housing member narrows at its first opening so as to generally surround and confine the bristles so as to preclude lateral movement thereof, thus providing a broom with very short stiff relatively movable bristles. The sweeping member automatically latches in its second retracted position. When the sweeping member is in its second retracted position, an electrical switch is actuated so as to turn on a suction means that is operatively connected to the interior of the housing member, thus to create a partial vacuum at the first opening of the housing member. In this manner, the vacuum assisted broom of the present invention can be used as conventional sweeping broom and also can be used to subsequently vacuum up any dust or dirt swept to a central location by the broom.

17 Claims, 10 Drawing Sheets

VACUUM ASSISTED BROOM

This application is a Continuation-In-Part application of application Ser. No. 07/942,784 filed Sep. 10, 1992, now abandoned.

FIELD OF THE INVENTION

This invention relates to sweeping brooms and also relates to vacuum powered cleaning devices.

BACKGROUND OF THE INVENTION

It is common for floors in buildings, such as houses and offices, to require the removal of debris—such as dirt, dust, and the like—on a regular basis. Further, the removal of randomly spilled debris may be required on an occasional basis. Obviously, the dust or dirt cannot merely be picked up, but must be either be vacuumed up, or swept to a localized area of the floor where it can then be picked up in some manner.

Vacuum cleaners are often used to perform the task of removing dust or dirt from a floor because they tend to do a thorough job and because the dust or dirt is immediately removed by the vacuum cleaner, and subsequent picking up of the dust or dirt is not required.

It is not always easy or convenient to vacuum this dust or dirt, however. It is therefore quite common to use a broom to sweep the dust or dirt into a localized area for subsequent pick up. Various types of brooms exist, such as a push broom, or a common bi-directional sweeping broom, among others. The bi-directional type of sweeping broom is the most usual since it is suitable for relatively quick general sweeping of a floor and allows for sweeping against walls, in comers, and so on. Further, these types of brooms are also relatively lightweight and easy to manipulate. Dirt or dust may be easily swept in any direction towards a localized area using mostly manipulation of the broom and minimizing the amount of walking that needs to be done.

Unfortunately, once brooms move dust and dirt to a localized area, they cannot be used to pick up the dirt or dust. Typically, a dust pan is used in conjunction with a broom to pick up the dirt or dust. Dust pans tend to be messy and inconvenient, however. Further, the dust or dirt in the dust pan must be subsequently disposed of elsewhere.

It is also possible to use a vacuum cleaner to vacuum up any dirt swept to a localized area by a broom. Using a vacuum cleaner in this manner, especially a small hand-held vacuum cleaner such as a DUST BUSTER™, appears sensible in some regards in that the vacuuming overcomes the problems of using a dust pan, and is therefore not messy, not overly inconvenient, and does not require subsequent further disposal of the dust or dirt. However, it seems somewhat illogical to use both a broom and a vacuum cleaner to rid a floor of dirt or dust when a broom is typically used because it is inconvenient to use a vacuum cleaner in the first instance.

It is also possible to use a small portable vacuum cleaner, either in the form of an "electric broom" or in the form of a hand-held vacuum, such as a DUST BUSTER™, to clean dust or dirt from a floor. The main problem with these types of vacuum cleaners is that they cannot sweep dust or dirt to a centralized location, even though the name "electric broom" suggests otherwise, and sweeping may sometimes be required.

Further, these small portable vacuum cleaners typically lack a high suction capacity and often rely on various ways of channelling their suction, as will be discussed subsequently.

DESCRIPTION OF THE PRIOR ART

U.S. Pat. No. 3,079,626 to YONKERS et al discloses a combination electric vacuum cleaner and floor scrubber. Basically, this is a portable "electric broom", at least in its electric vacuum cleaner configuration, that employs an interchangeable vacuum cleaner head element and a floor scrubber head element in order to convert to a floor scrubber. In the electric vacuum cleaner configuration, commonly referred to as an "electric broom", the vacuum cleaner is not configured whatsoever to act as a broom—only as a vacuum cleaner—and such use is not contemplated.

U.S. Pat. No. 4,956,892 to FAWKES discloses a cordless vacuum brush, wherein the vacuum brush has a plurality of soft brush bristles located around an intake in the perimeter of the bottom portion of the brush head. This unit cannot be used as a broom—it is merely a small vacuum cleaner—and such use is not contemplated.

U.S. Pat. No. 1,971,493 to LEATHERS discloses a vacuum cleaner having a head portion with a pivotable central brush. There are front and rear gaps between the brush and the head portion, which gaps permit the passage of air and debris through the vacuum cleaner head. The brush pivots forwardly and rearwardly in conjunction with corresponding rearward and forward movement of the vacuum cleaner head across the surface being vacuumed. In its forward pivoted position, the brush contacts a soft projection at the front of the vacuum cleaner head portion so as to close off the front gap and to open the rear gap wider to allow for maximum air flow. Similarly, in its rearward pivoted position, the brush contacts a soft projection at the rear of the vacuum cleaner head portion so as to close off the rear gap and open the front gap wider to allow for maximum air flow. The brush in this vacuum cleaner is not, however, suitable for sweeping and cannot perform the type of sweeping action that a broom performs, and such use is not contemplated.

U.S. Pat. No. 2,236,989 to BJORKMAN discloses a vacuum cleaner having a head that is somewhat similar to the vacuum cleaner head disclosed in U.S. Pat. No. 1,971,493, in that the brush moves within the vacuum cleaner head to maximize air flow through the head during vacuuming. This brush moves slidably within the vacuum cleaner head as opposed to pivotally. Again, this brush is not suitable for use as a broom, and such use is not contemplated.

U.S. Pat. No. 2,180,930 to MORTENSEN discloses a vacuum cleaner that has another configuration of a movable brush within the vacuum head. Again, this brush is not suitable for use as a broom, and such use is not contemplated.

SUMMARY OF THE INVENTION

In accordance with one aspect of the present invention, there is provided a vacuum assisted broom for sweeping floors and the like. This broom has a sweeping member, preferably in the form of a plurality of stiff bristles, for bi-directional sweeping of the floor. The sweeping member is operatively mounted within a housing member, which housing member partially encloses the sweeping member within its hollow interior such that the bristles depend from the housing member through a first opening. A handle member is securely attached to the housing member and extends upwardly therefrom. The sweeping member is movable between a first extended position whereat the bristles are extended sufficiently that the broom may be used as a conventional broom. The sweeping member is movable between this first extended position and a second retracted position whereat the sweeping member is substantially retracted into the housing member, with only a short end portion of the bristles extending outwardly from the housing member. The housing member narrows at its first opening so as to generally surround and confine the bristles so as to preclude lateral movement thereof, thus providing a broom with very short stiff relatively unmovable bristles. The sweeping member automatically latches in its second retracted position. Further, when the sweeping member is in its second retracted position, an electrical switch is actuated so as to in turn actuate a suction means that is operatively connected to the interior of the housing member, thus to create a partial vacuum at the first opening of the housing member. In this manner, the vacuum assisted broom of the present invention can be used as conventional sweeping broom and also can be used to subsequently vacuum up any dust or dirt swept to a central location by the broom.

BRIEF DESCRIPTION OF THE DRAWINGS

Embodiments of this invention will now be described by way of example in association with the accompanying drawings in which.

DETAILED DESCRIPTION OF THE PREFERRED EMBODIMENTS

Figure 1:
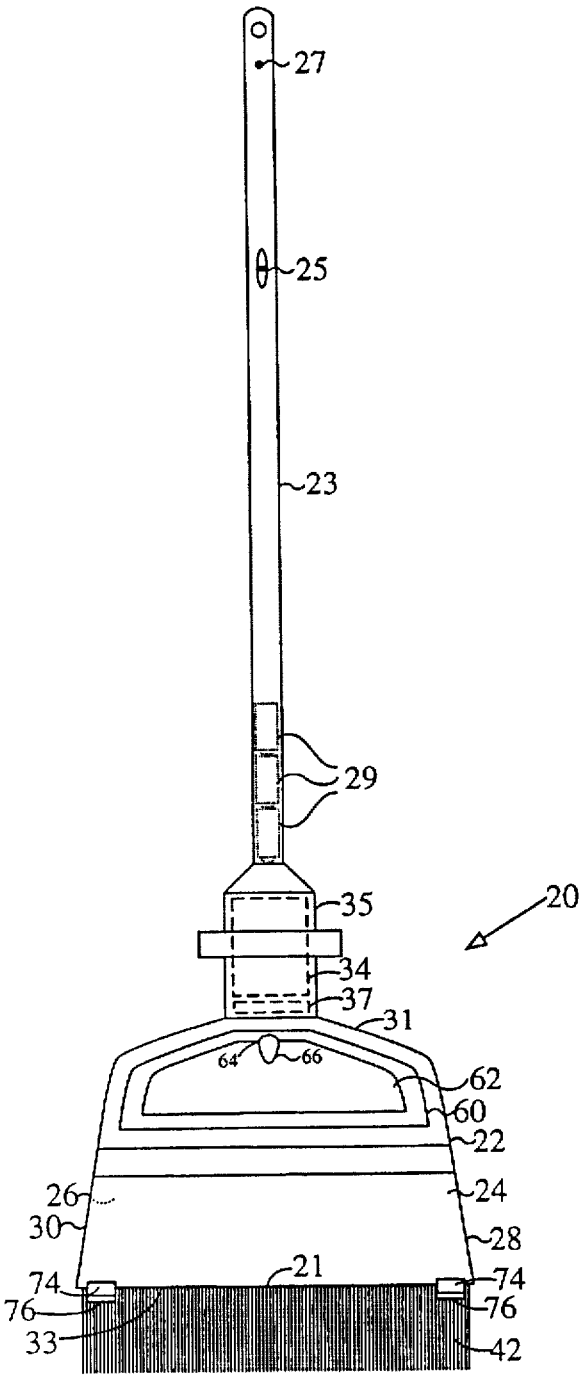
FIG. 1 is a front elevational view of the vacuum assisted broom of the present invention, with the bristles in their extended position.
Figure 2:
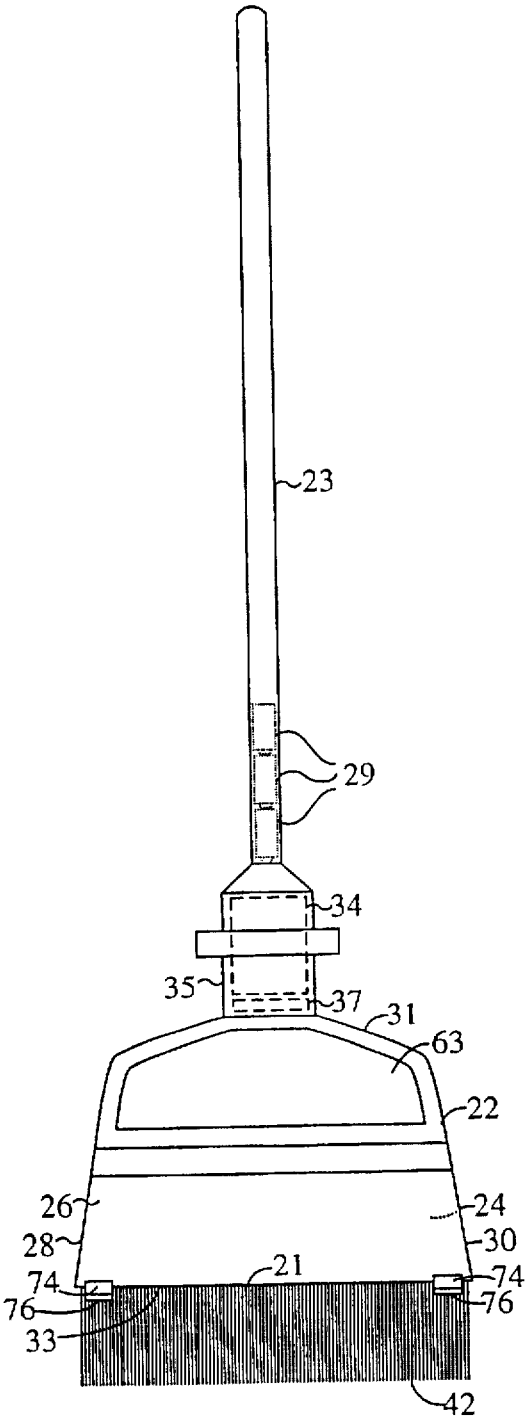
FIG. 2 is a rear elevational view of the vacuum assisted broom as shown in FIG. 1.
Figure 3:
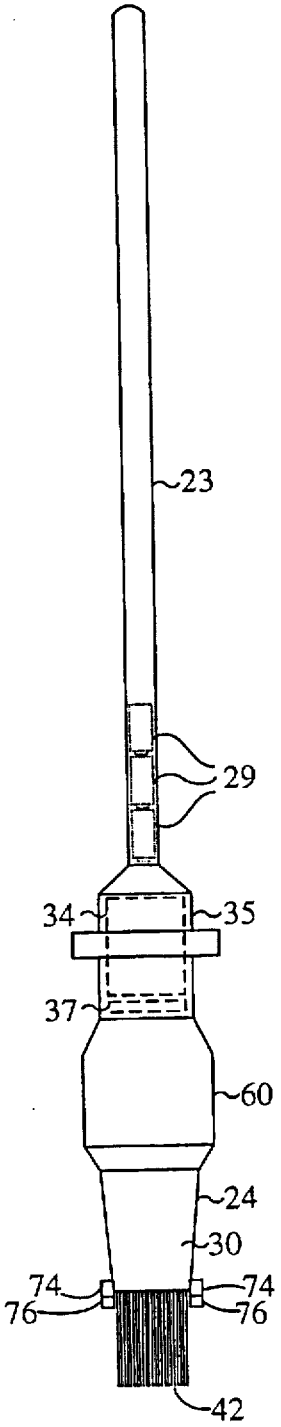
FIG. 3 is a side elevational view of the vacuum assisted broom as shown in FIG. 1.

Reference will now be made to FIGS. 1 to 16, which show the vacuum assisted broom 20 of the present invention, and also show separately various components thereof. The vacuum assisted broom 20 is used for sweeping a sweepable surface, such as a floor or the like, in order to sweep debris such as dust and dirt to a localized area and to subsequently vacuum up this debris. A sweeping member 40 in the form Of a plurality of broom bristles 42 is adapted for bi-directional sweeping of a sweepable surface such as a floor or the like. The broom bristles 42 may be of any conventional type, or may even be of a specialized type if desired.

A housing member 22 having interconnected walls—front wall 24, rear wall 26, and side walls 28 and 30, a closed top portion 31, and a first opening 33 at the bottom thereof—together defining a hollow interior 32, is shaped and dimensioned to generally surround and thereby house the sweeping member 40, a filter member 36, and a debris collection compartment 38 for collecting the debris that is vacuumed up by the vacuum assisted broom 20 and is filtered out by the filter member 36. A suction means in the form of an electric motor 34 and suitable fan 37 resides within its own generally cylindrical enclosure 35 that extends upwardly from the closed top portion 31 of the housing member 22.

Extending upwardly from the generally cylindrical enclosure 35 is an elongate handle member 23, which is preferably threadibly engaged on the generally cylindrical enclosure 35 at the top thereof. The elongate handle member 23 is thereby removably attached to the enclosure 35, for purposes of shipping and also to permit interchangeable handle members of different lengths. A short handle member suitable to allow manipulation of the vacuum assisted broom 20 by way of one hand only may be desirable in certain instances. An electrical switch 25 for selectively activating the electric motor 34 is located at a convenient upper portion of the elongate handle member 23. An indicator light 27 may be used to indicate that electrical power is switched on or that the batteries 29 are being charged. In order to provide power for recharging the batteries 29, a low voltage electrical adapter (not shown) is used. The electrical adaptor plugs into a conventional 110 VAC electrical outlet and the plug at the end of the electrical cord plugs into an electrical connector 31 on the handle member 23.

Figure 4:
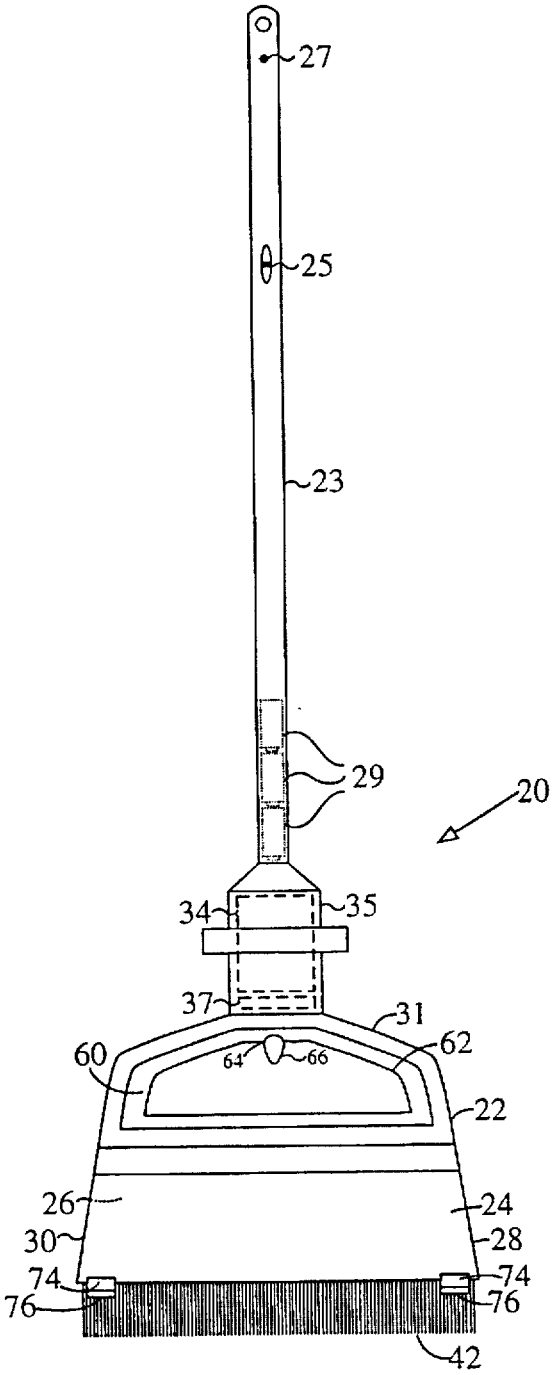
FIG. 4 is a front elevation view of the vacuum assisted broom as shown in FIG. 1, except with the bristles in their retracted position.
Figure 5:
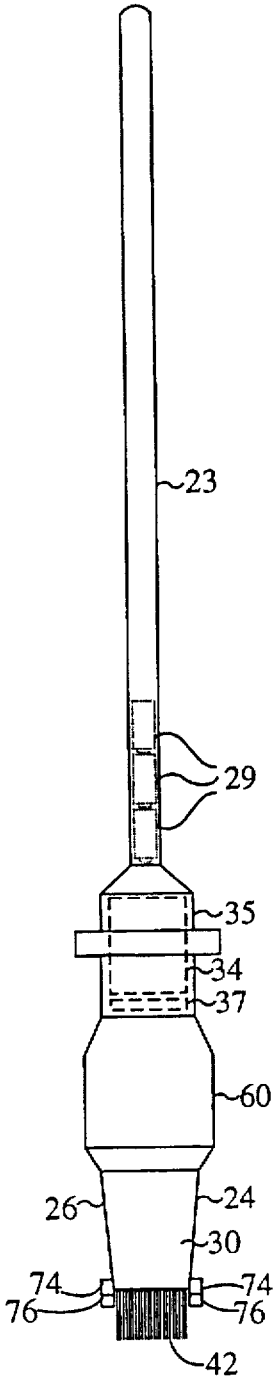
FIG. 5 is a side elevational view of the vacuum assisted broom as shown in FIG. 4.
Figure 6:
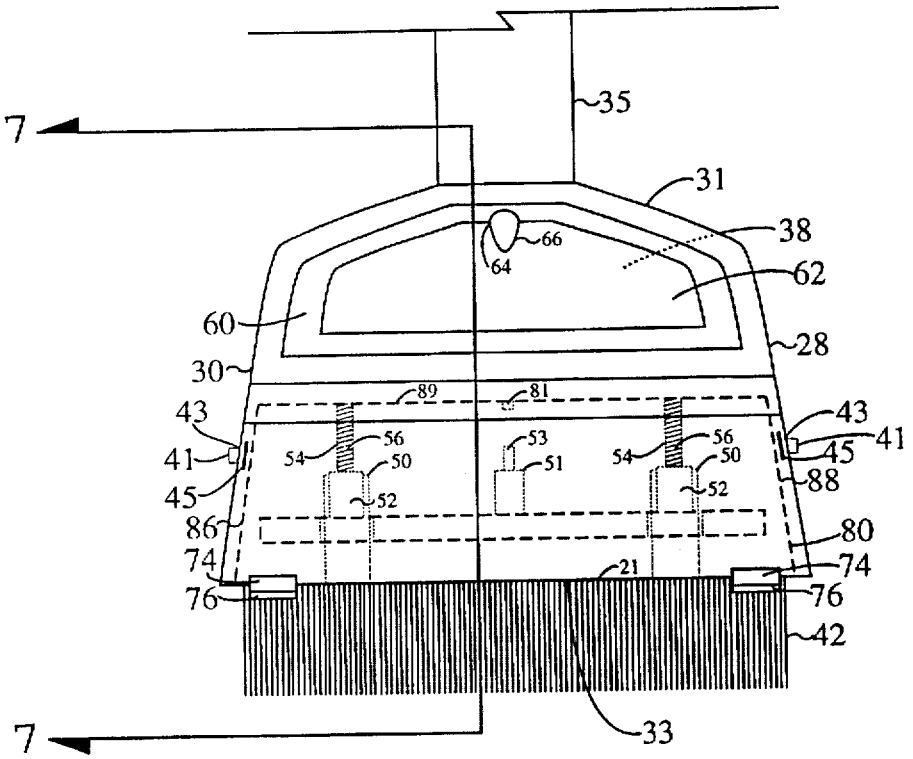
FIG. 6 is an enlarged front elevational view of the head portion of the vacuum assisted broom as shown in FIG. 1.
Figure 7:
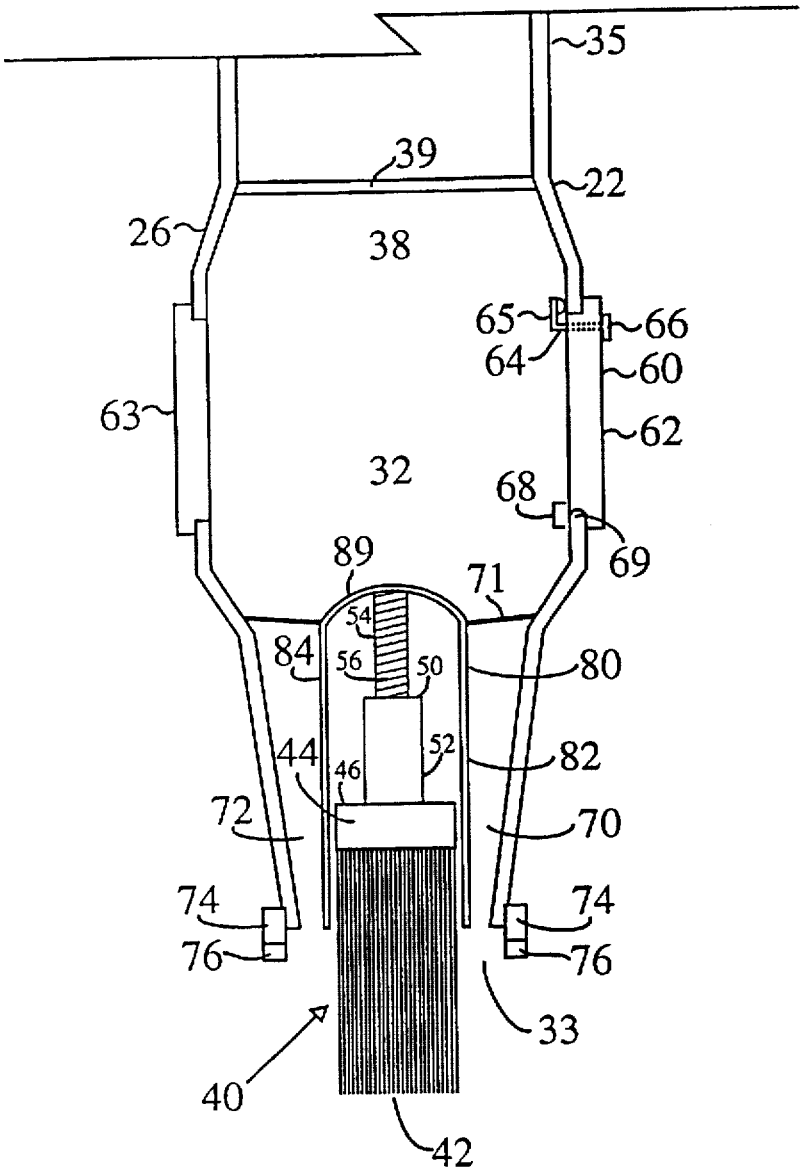
FIG. 7 is a sectional side view along 7—7, of the head portion of the vacuum assisted broom, as shown in FIG. 6.
Figure 8:
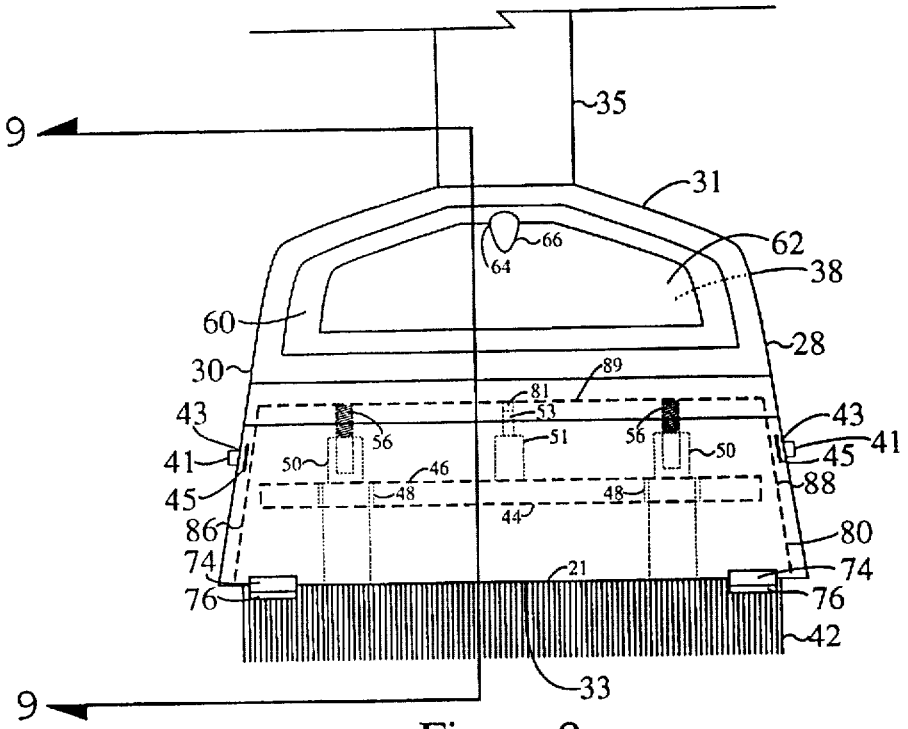
FIG. 8 is an enlarged front elevational view similar to FIG. 6, of the vacuum assisted broom as shown in FIG. 4.
Figure 9:
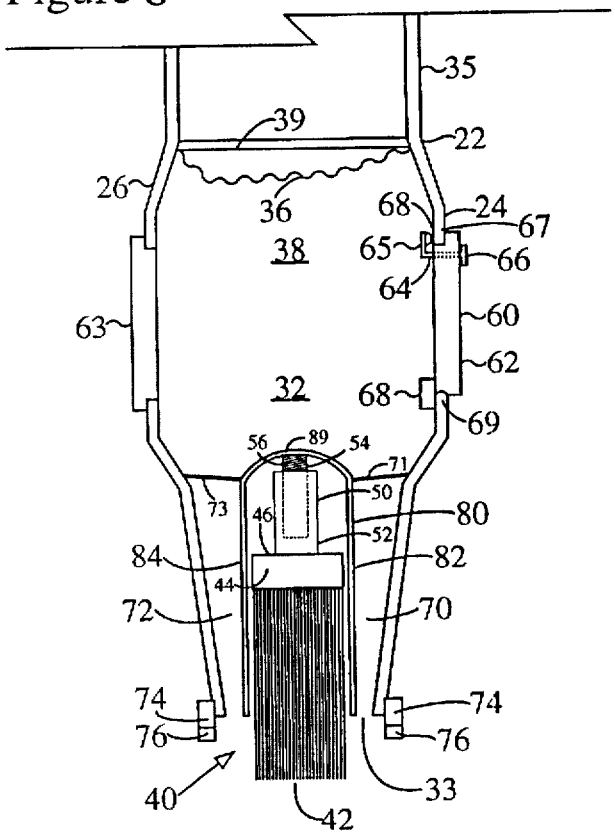
FIG. 9 is a sectional side elevational view along section line 9—9, of the head portion of the vacuum assisted broom as shown in FIG. 8.
Figure 10:
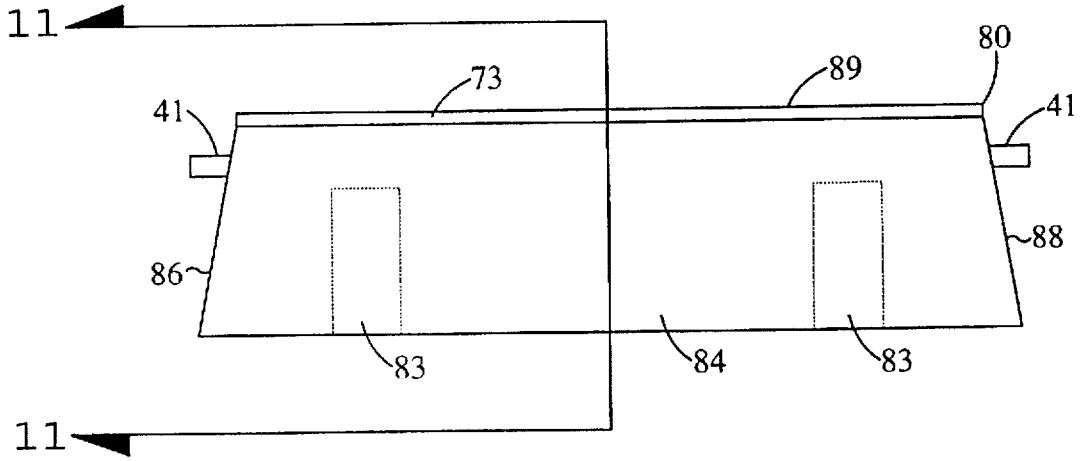
FIG. 10 is a front elevational view of the encasement member within the head portion.
Figure 11:
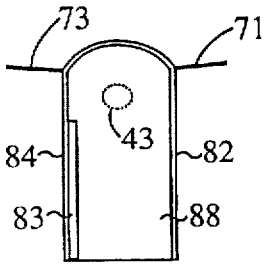
FIG. 11 is a sectional side view elevational along section line 11—11, of the encasement member of FIG. 10.
Figure 12:
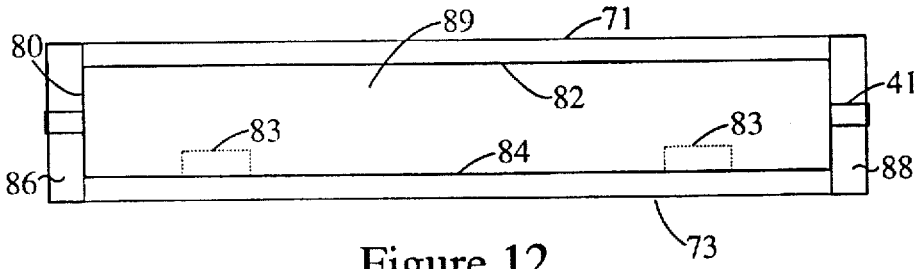
FIG. 12 is a top view of the encasement member of FIG. 10.
Figure 13:
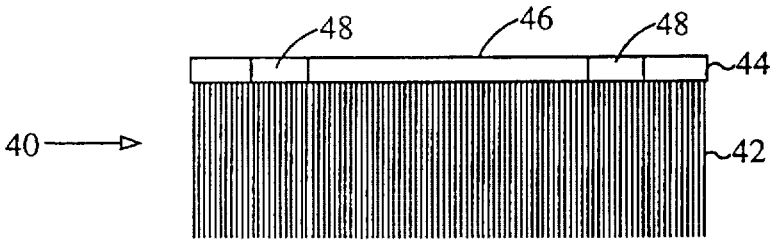
FIG. 13 is front elevational view of the sweeping member of the vacuum assisted broom of the present invention.
Figure 14:
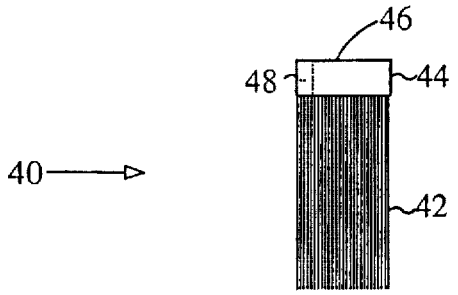
FIG. 14 is an end elevational view of the sweeping member shown in FIG. 13.
Figure 15:
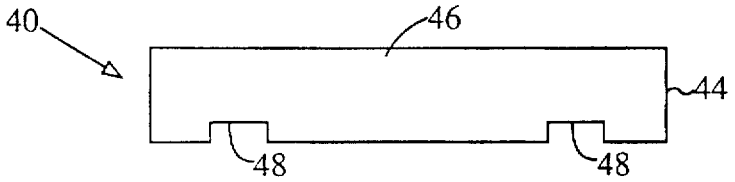
FIG. 15 is a top plan view of the sweeping member shown in FIG. 13.

The sweeping member 40 comprises a plurality of bristles 42 conventionally mounted within a horizontally displaced head portion 44. The sweeping member 40 is slidably mounted within a confinement member 80 for vertical sliding movement between a first extended position as shown in FIG. 1, and a second retracted position as shown in FIG. 4. The confinement member 80 comprises a front wall 82, a rear wall 84, side walls 86 and 88, and a top portion 89 that closes off the confinement member 80 so as preclude the passage of debris therethrough. The head portion 44 of the sweeping member 40 has a pair of slots 48 therein, which slots 48 co-operatingly interact with a corresponding pair of vertically disposed rails 83 on the interior of the confinement member 80.

In the first extended position of the sweeping member 40, the broom bristles 42 extend outwardly from the housing member 22 through the first opening 33 by perhaps about 1 inch to about 3 inches so as to form a conventional sweeping broom. In the second retracted position, the broom bristles 42 extend outwardly from the housing member 22 through the first opening 33 by about only ½ inch, thus forming a stiff-bristled brush-like broom suitable for hard sweeping. The remaining upper portion of the broom bristles 42 are physically confined within confinement member 80 such that the upper portion of the broom bristles 42 confined therein are precluded from moving mainly by the first wall 82 and the second wall 84. In this manner, the confinement member 80 limits the lateral motion of the bristles during sweeping, thus permitting a substantially more stiff sweeping action of the bristles, as compared to when in their fully extended position. This more stiff sweeping action is very useful when sweeping some types of debris such as tracked in mud that has now dried and might have partially stuck to the floor. Further, having the sweeping member 40 in its first extended position allows the first opening 33 to be close to the surface being swept for the purpose of vacuuming.

Mounted on the top of the head portion 44 of the sweeping member 40, so as to be operatively connected between the sweeping member 40 and the housing member 22, are a pair of mechanical latch devices 50. Each mechanical latch device 50 comprises a lower portion 52 securely connected to the head portion 44 of the sweeping member 40 and an upper portion 54 securely connected to the top portion of the confinement member 80. The upper portion 54 of the mechanical latch device 50 is slidably mounted within the lower portion 52. In this manner, the two mechanical latch devices 50 act as track members to operatively retain the sweeping member 40 for vertical sliding movement within the confinement member 80 between a first extended position and a second retracted position. Further, each of the mechanical latch devices 50 have internal releasable latches (not shown) that cause the sweeping member 40 to be releasably latched in its second retracted position, upon reaching that second retracted position. In actuality, due to the inherent nature of mechanical latch systems—that is to say the mechanical hysteresis that is typically found in conventional mechanical latch systems of this type—the sweeping member 40 must be moved slightly beyond the actual latching position in order for latching to occur. The sweeping member 40 then moves very slightly in the opposite direction back towards the first extended position to its second retracted position by way of a spring member 56 within each of the mechanical latch devices 50. The spring members 56 also bias the sweeping member 40 towards its first extended position so as to help keep the sweeping member 40 in that first extended position during normal sweeping. The sweeping member 40 may be moved from its first extended position to its second retracted position by means of increased upward force on the sweeping member 40. This increased upward force on the sweeping member 40 is usually caused by pushing the vacuum assisted broom 20 downwardly against a floor while holding onto the handle member 23.

The housing member 22 also has a removable and replaceable door member 60 on the front thereof. This door member 60 allows access to the debris collection compartment 38 so as to permit emptying debris therefrom. Preferably, the door member 60 has a window 62 therein to permit visual monitoring of the amount of debris in the debris collection compartment 38. A release mechanism 64 is mounted on the door member 60 so as to engage a first lip portion 67 of the housing member 22 in interfering relation therewith. The release handle 66 is pivotable so as to permit a catch arm 65 of the release mechanism 64 to move into and out of engagement with the first lip portion 67 of the housing member 22. The bottom end of the door member 60 has a pair of flanges 68 thereon that fit behind a second lip portion 69 of the housing member 22 in interfering relation therewith so as to retain the door member 60 in place on the housing member 22. There may also be a fixed window 63 on the opposite other side of the housing member 22.

The confinement member 80 is pivotably mounted with respect to the housing member 22 by way of a pair of mounting pins 41, one at each opposite end of the confinement member 80, which mounting pins 41 engage co-operating apertures 43 in the housing member 22. A plastic annular spacer 45 surrounds a central portion of each of the mounting pins 41 so as to preclude the confinement member 80 from moving from side-to-side within the housing member 22 and also to preclude debris such as dust and dirt from reaching the mounting pins 41 and apertures 43.

As stated earlier, a suction means in the form of the electric motor 34 and fan 37 are mounted on the closed top portion 31 of the housing member 22 and are operatively connected thereto by way of a second opening 39 in the top portion 31 of the housing member 22. In this manner, the suction means is in fluid communication with the hollow interior 32 of the housing member 22 so as to thereby be able to create a partial vacuum at the first opening 33 of the housing member 22 when the electric motor 34 is energized. In the preferred embodiment, the electric motor 34 is powered by batteries 29 retained within the elongate handle member 23.

An electrical switch 25 on the elongate handle member 23 is used to manually turn on and off the automatic electrical function of the vacuum assisted broom 20, as will now be detailed. The suction means is automatically actuatable by way of the change in positioning of the sweeping member 40 between its first extended position and its second retracted position. A switch means in the form of an electrical switch 51 securely attached to the top surface 46 of the head portion 44. The electrical switch 51 is closed by way of movement of the sweeping member 40 upwardly until the handle portion 53 of the electrical switch 51 contacts a protruding actuation member 81 on the top portion 89 of the confinement member 80, when the sweeping member 40 reaches its second retracted position. When the electrical switch 51 becomes closed, the electric motor 34 is energized, thus causing a partial vacuum at the first opening 33 of the housing member 22—in other words, the vacuum is turned on. In this manner, the electrical switch 51 is operatively mounted between the housing member 22 and the sweeping member 40.

The vacuum assisted broom 20 further comprises a selectively closable front inlet 70 located between the sweeping member 40 and the front wall 24 of the housing member 22, and a selectively closable rear inlet 72 located between the sweeping member 40 and the rear wall 26 of the housing member 22. The sweeping member 40 is operatively mounted by way of the aforedescribed mounting pins 41 for movement between a forward position and a rearward position. In the forward position the front inlet 70 is substantially closed so as to preclude the passage of air and debris therethrough and the rear inlet 72 is fully open so as to permit the passage of air and debris therethrough. In the rearward position, the rear inlet 72 is substantially closed so as to preclude the passage of air and debris therethrough, and the front inlet 70 is fully open so as to permit the passage of air and debris therethrough. Located at the top of each of the front and rear inlets 70 and 72 are respective rubber seals 71 and 73 respectively. These rubber seals 71 and 73 can deflect upwardly so that the dust and debris can enter the debris collection compartment 38, but subsequently preclude the dust and debris from exiting the debris collection compartment 38 through the front and rear inlets 70 and 72.

Four leg members 74 depend from the bottom edge 21 of the housing member 22. These leg members 74 are positioned so as to contact a sweepable surface when the sweeping member 40 is in its second retracted position. Further, these leg members 74 are shaped and dimensioned to preclude the bottom edge 21 of the housing member 22 from contacting the sweepable surface, thus always maintaining a gap between the sweepable surface and the bottom edge 21 of the housing member 22. This gap is suitable for allowing the passage of air and debris therethrough. In this manner, since there is always a suitable gap between the housing member 22 and the sweepable surface, the path that air and debris must travel along to reach the first opening 33 is never blocked.

Figure 17:
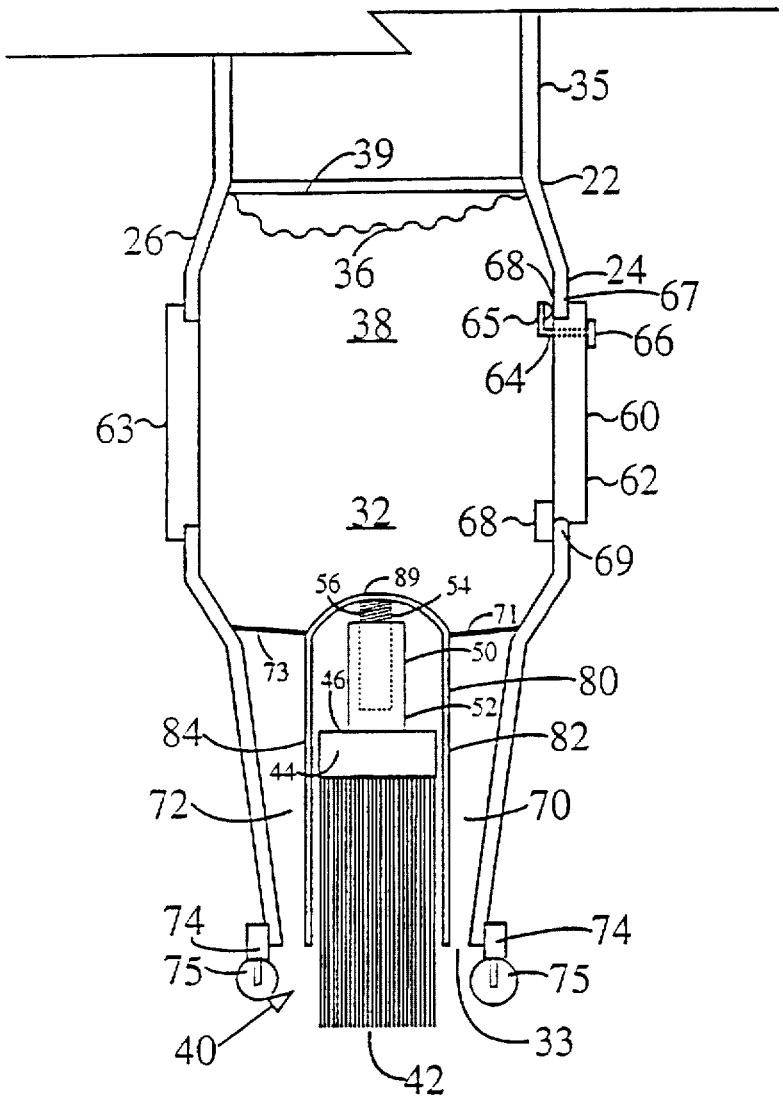
FIG. 17 is a sectional side elevational view of a portion of another alternative embodiment of the vacuum assisted broom of the present invention.

In the preferred embodiment, the leg members 74 may have a small felt pads 76 on the ends thereof to preclude scratching of a floor. Alternatively, a small wheel member 75 may be rotatably attached to each of the leg members 74 so as to extend below each respective leg member 74, to thereby be adapted for rolling contact with the floor, as can best be seen in FIG. 17.

In use, the vacuum assisted broom 20 is used to sweep debris such as dust and dirt on a sweepable surface such as a floor, to a localized area, with the sweeping member 40 in its fully extended position. The vacuum assisted broom 20 is then pushed downwardly against the floor being swept such that the sweeping member 40 is moved upwardly into the housing member 22 from its first extended position to its second retracted position. As described previously, at the second retracted position, the electrical switch 51 on the head portion 44 of the sweeping member 40 moves such that the handle member 53 of the electrical switch 51 contacts the protruding actuation member 81 on the top portion 89 of the confinement member 80 so as to electrically close the electrical switch 51 and thereby energize the electric motor 34. In this manner, the suction means is selectively actuated by way of the change in positioning of the sweeping member 40 between its first extended position and second retracted position. The mechanical latch devices 50, which are operatively connected between the housing member 22 and the head portion 44 of the sweeping member 40, as aforedescribed, retain the sweeping member 40 in its second retracted position. Debris may then be vacuumed up through the first opening 33 in the housing member 22, passing through one or both of the front inlet 70 and rear inlet 72, and ultimately into the debris collection compartment 38. Once vacuuming is finished, the vacuum assisted broom 20 is again pushed downwardly against the floor so as to cause the mechanical latch devices 50 to release and permit the spring members 56 to return the sweeping member 40 to its fully extended position. In this manner, the sweeping member 40 is releasably latchable in its second retracted position.

In an alternative embodiment, an electrical switch means may be operatively mounted between the housing member 22 and the leg members 74 such that when the vacuum assisted broom 20 is pressed downwardly against a floor and the sweeping member 40 is thereby moved to its second retracted position, and the leg members 74 contact the floor, the electrical switch is closed so as to energize the electric motor 34, to thereby selectively actuate the suction means.

In another alternative embodiment of the present invention, it is contemplated that a broom would have a sweeping member adapted for bi-directional sweeping of a surface, mounted on a housing member for movement between a first extended position and a second extended position. The housing member having interconnected front, rear, and side walls defining a hollow interior, is shaped and dimensioned to generally surround at least the top portion of the sweeping member. The sweeping member is operatively mounted on the housing member such that the bristles of the sweeping member extend outwardly therefrom through a first opening in the housing member. A handle member is securely attached to the housing member and extends upwardly therefrom.

In the first extended position, the bristles extend outward to their full extent from the first opening of the housing member to form a conventional sweeping broom, thereby permitting sweeping of a floor using a broom-like sweeping action. In the second retracted position, the sweeping member is substantially retracted into the housing member such that only a small end portion of the bristles extend outwardly therefrom through the first opening by only about ½ inch, thus forming a stiff-bristled brush-like broom. The remaining upper portion of the broom bristles are physically confined within a confinement member such that the upper portion of the broom bristles confined therein can move no more than very slightly. In this manner, the confinement member limits the lateral motion of the bristles during sweeping, thus permitting a substantially more stiff sweeping action of the bristles, as compared to when in their fully extended position. This more stiff sweeping action is very useful when sweeping some types of debris such as mud that has dried on a floor.

Figure 16:
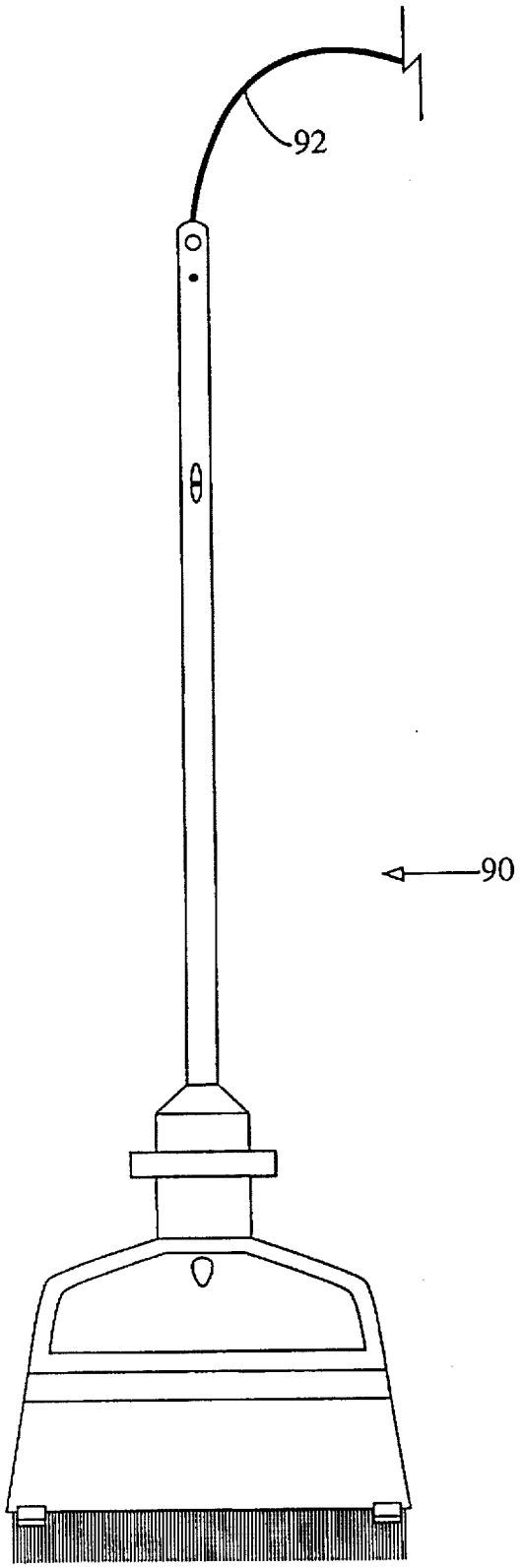
FIG. 16 is a front elevational view of a household current powered alternative embodiment of the vacuum assisted broom of the present invention.

In another alternative embodiment, as shown in FIG. 16, it is contemplated that the vacuum assisted broom 90 of the present invention could be plugged into a conventional 110 VAC outlet by means of an electrical cord 92, so as to be directly powered by hydro-electric current.

In yet another alternative embodiment, it is envisioned that the suction means may be operatively mounted with respect to the housing member by way of an elongate hose in fluid communication with the housing member through the elongate broom handle. This embodiment of the vacuum assisted broom could be operatively connected to a central vacuuming system, which would provide for a very high amount of vacuuming power, but which would also provide a broom to perform conventional sweeping.

Other modifications and alterations may be used in the design and manufacture of the mechanical security apparatus of the present invention without departing from the spirit and scope of the accompanying claims.

What is claimed is:

1. A vacuum assisted broom for sweeping a sweepable surface, said broom comprising:

a housing member having interconnected front, rear and side walls defining a hollow interior and being shaped and dimensioned to generally surround at least the top portion of a sweeping member;

a handle member securely attached to said housing member and extending upwardly therefrom;

a selectively actuatable suction means operatively connected to said housing member by way of a second opening in said housing member such that said hollow interior is in fluid communication with said suction means so as to thereby create a partial vacuum at said first opening; and a sweeping member movably mounted within said housing member so as to depend therefrom through a first opening in said housing member, for selective movement between a first extended position whereat said sweeping member extends outwardly from said first opening in said housing member to thereby permit the sweeping of said sweepable surface using a broom-like sweeping action, and a second retracted position whereat said sweeping member is substantially reacted into said housing member so as to allow said first opening in said housing member to be in close proximity to said sweepable surface, to thereby permit vacuuming of debris frown said sweepable surface, upon actuation of said suction means.

2. The vacuum assisted broom of claim 1, further comprising switch means operatively mounted between said housing member and said sweeping member, said switch means actuatable by way of the change in positioning of said sweeping member between said first extended position and said second retracted position so as to thereby cause selective actuation of said suction means.

3. The vacuum assisted brook of claim 1, wherein said sweeping member comprises a plurality of broom bristles.

4. The vacuum assisted broom of claim 1, further comprising a selectively closable front inlet located between said sweeping member and the front wall of said housing member and a selectively closable rear inlet located between said sweeping member and the rear wall of said housing member, with said sweeping member operatively mounted for movement between a forward position whereat said rear inlet is fully open so as to permit the passage of air and debris therethrough and said front inlet is substantially closed so as to preclude the passage of air and debris therethrough, and a rearward position whereat said front inlet is fully open so as to permit the passage of air and debris therethrough and said rear inlet is substantially closed so as to preclude the passage of air and debris therethrough.

5. The vacuum assisted broom of claim 4, wherein said sweeping member is pivotally mounted with respect to said housing member.

6. The vacuum assisted broom of claim 1, wherein said handle member is an elongate broom handle.

7. The vacuum assisted broom of claim 1, further comprising a plurality of leg members depending from the bottom of said housing member, said leg members positioned so as to contact said sweepable surface and shaped and dimensioned to preclude the bottom of said housing member from contacting said sweepable surface, thus creating a gap between said sweepable surface and the bottom of said housing member, said gap suitable for allowing passage of debris therethrough.

8. The vacuum assisted broom of claim 7, wherein said leg members depend from the bottom area of said from and rear wails of said housing member.

9. The vacuum assisted broom of claim 8, wherein each leg member has a wheel member rotatably attached thereto so as to extend below said leg member, to thereby be adapted for rolling contact with said sweepable surface.

10. The vacuum assisted broom of claim 1, further comprising a plurality of leg members depending from the bottom of said housing member, said leg members positioned so as to contact said sweepable surface and shaped and dimensioned to preclude the bottom of said housing member from contacting said sweepable surface, thus creating a gap between said sweepable surface and the bottom of said housing member, said gap sintable for allowing the passage of debris therethrough.

11. The vacuum assisted broom of claim 1, wherein said sweeping member is spring biased towards said first extended position by way of a biasing spring.

12. The vacuum assisted broom of claim 11, further comprising a latching means operatively connected between said housing member and said sweeping member to thereby cause said sweeping member to be releasably latchable in said second retracted position.

13. The vacuum assisted broom of claim 12, wherein said latching member automatically releasably latches said sweeping member in said second retracted position when said sweeping member reaches said second retracted position.

14. The vacuum assisted broom of claim 13, wherein said sweeping member is movable from said first extended position to said second retracted position by way of pressing said sweeping member against said sweepable surface.

15. The vacuum assisted broom of claim 14, wherein said latching means is released so as to permit said sweeping member to move from its second retracted position to its first extended position, as biased by said biasing spring, by way of pressing said sweeping member against said sweepable surface.

16. A broom for sweeping a sweepable surface, said broom comprising:

a housing member having interconnected front, rear and side walls defining a hollow interior and being shaped and dimensioned to generally surround at least a top portion of a sweeping member;

a handle member securely attached to said housing member and extending upwardly therefrom; and a sweeping member movably mounted within said housing member so as to extend outwardly therefrom through a first opening in said housing member and movable between a first extended position whereat said sweeping member extends outwardly from said first opening in said housing member to thereby permit the sweeping of said sweepable surface using a broom-like sweeping action and a second retracted position whereat said sweeping member is substantially retracted into said housing member such that only a small end portion of said sweeping member extends outwardly therefrom through said first opening, and further such that said front and rear walls of said housing member closely surround said sweeping member to thereby restrict the relative lateral movement of said sweeping member with respect to said housing member, thus permitting a substantially more stiff sweeping action.

17. The vacuum assisted broom of claim 1, further comprising switch means operatively mounted between said housing member and said leg member, said switch means being actuated upon change in position said sweeping member from said first extended position to said second retracted position as to thereby cause corresponding actuation of said suction means, and being deactuated upon change in position of said sweeping member from said second retracted position to said first extended position so as to thereby cause corresponding deactuation of said suction means.

* * * * *